US005154265A

United States Patent [19]

Capistrant

[11] Patent Number: 5,154,265

[45] Date of Patent: Oct. 13, 1992

[54] RETRACTABLE WHEEL ASSEMBLY

[75] Inventor: Stephen G. Capistrant, 5306 Gordon Dr., Centreville, Va. 22020

[73] Assignees: Stephen G. Capistrant; Susan D. Capistrant, both of Centreville, Va.

[21] Appl. No.: 852,953

[22] Filed: Mar. 17, 1992

[51] Int. Cl.[5] ..... A45C 13/00

[52] U.S. Cl. ..... 190/18 A; 16/34

[58] Field of Search ..... 16/34, 29; 190/18 A

[56] References Cited

U.S. PATENT DOCUMENTS

| | | | |
|---|---|---|---|
| 2,439,660 | 4/1948 | Keil | 190/18 A |
| 2,581,417 | 1/1952 | Jones | 16/34 |
| 4,097,955 | 7/1978 | Foge et al. | 190/18 A |
| 4,647,056 | 3/1987 | Baker | 190/18 A |

*Primary Examiner*—John Sipos

*Assistant Examiner*—Carmine Cuda

*Attorney, Agent, or Firm*—Walter F. Wessendorf, Jr.

[57] ABSTRACT

A retractable wheel assembly, housed in an inverted well, has an elongated arm mounting wheels, is pivotally mounted in the well and is pivotally movable manually between a retracted position by which the arm is releasably locked interiorly of the inverted well and an extended operative position by which the arm is releasably locked with its wheels exposed. The arm has spring-biased detents for such manipulatively releasable locking engagements with detent recesses for both positions. Wheel assemblies in bottom rear-corner wells of a suitcase allow "wheel-barrowing" movement of the suitcase. Wheel assemblies in the bottom inverted wells at all four suitcase corners allow "trolleying" movement of the suitcase.

8 Claims, 4 Drawing Sheets

2/4
FIG. 3
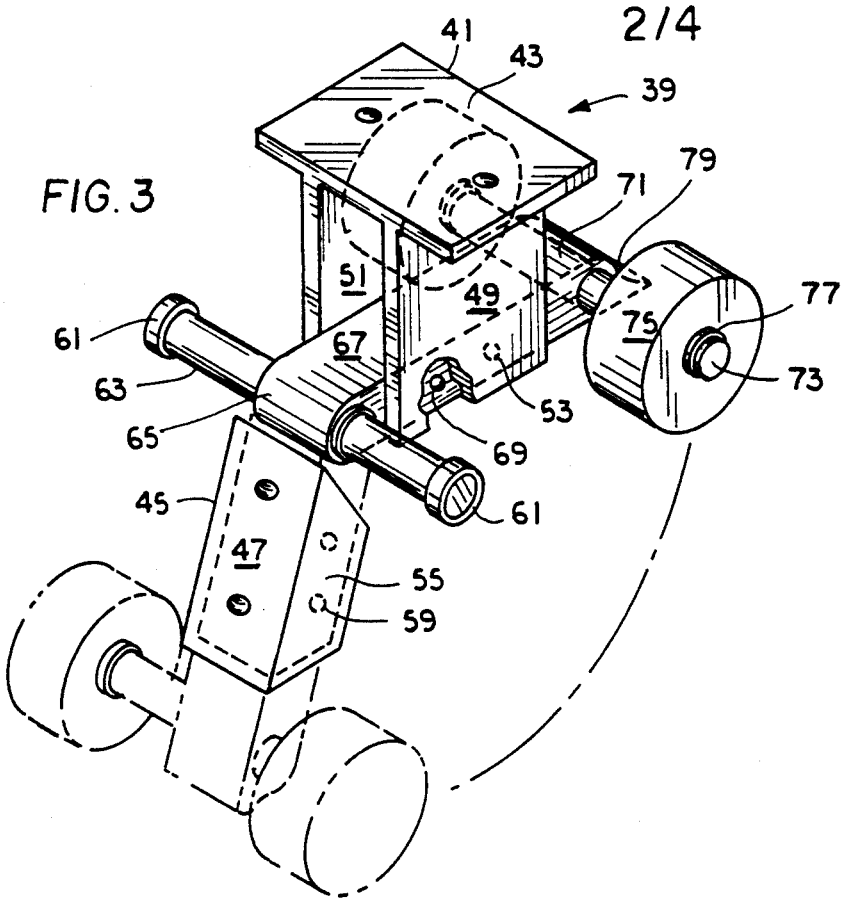
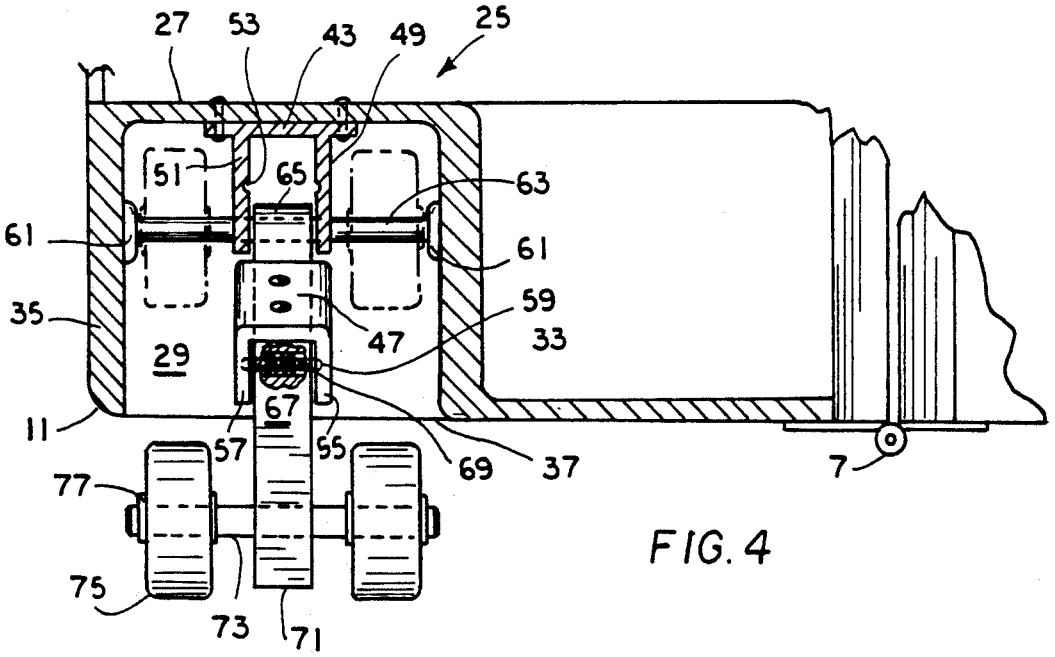
FIG. 4

3/4

RETRACTABLE WHEEL ASSEMBLY

BACKGROUND OF THE INVENTION

1. Technical Field

This invention relates to a retractable wheel assembly for an article of luggage, such as a suitcase.

2. Background

Some suitcases have conventional rollers or wheels that are fixed in their exposed and operative positions which subject the wheels to damage after the suitcases are checked-in by an airline passenger and returned to the passenger at his or her destination, as attested to by the number of damage claims to which the airlines are subjected for damage to the luggage, in general, and damage to the rollers and wheels, in particular.

SUMMARY OF THE INVENTION

Accordingly, the object of the invention is to contribute to the solution of the discussed problem of the art by providing a retractable wheel assembly that can simply be moved manually by a passenger, at check-in, from an extended operative position to its retracted position in which none of the wheels are exposed and subject to damage; and, when reaching his destination, such passenger, at baggage pick-up, can simply manually move the retractable wheel assemblies to their extended operative positions to expose the wheels for purposes of "wheel-barrowing" or "trolleying" movement of the suitcase.

BRIEF DESCRIPTION OF THE DRAWINGS

This object and other objects of the invention should be discerned and appreciated from the detailed description of the preferred embodiment taken in conjunction with the drawing figures, wherein like reference numerals refer to similar parts throughout the several views, in which:

FIG. 3 is a perspective view of the wheel assembly;

FIG. 4 is a rear-elevational view, partly in section;

DETAILED DESCRIPTION OF THE PREFERRED EMBODIMENT

Figure 1:
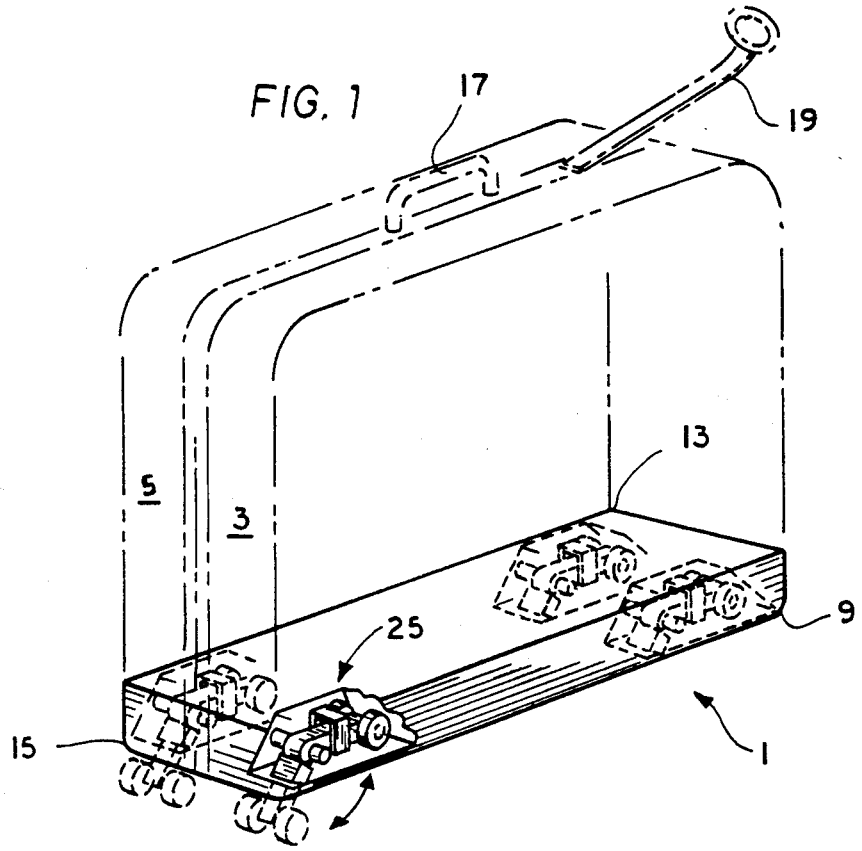
FIG. 1 is a perspective view of the invention.
Figure 2:
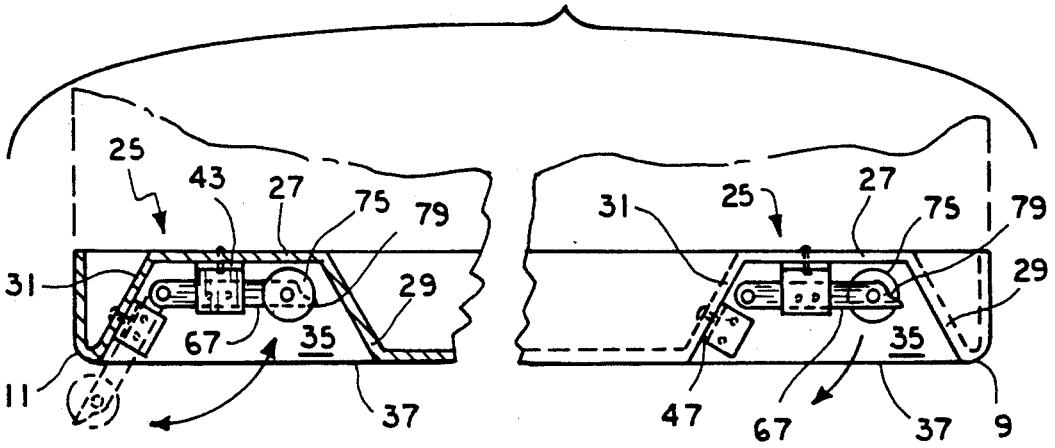
FIG. 2 is a side-elevational view, partly in section.
Figure 6:
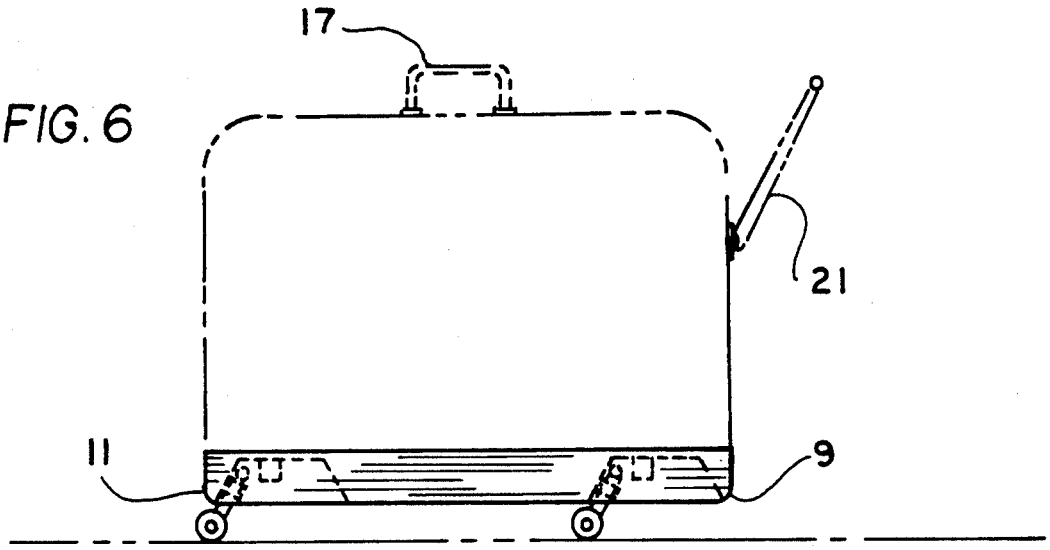
FIG. 6 is a side-elevational view showing a suitcase, with its front and rear wheels in their extended operative positions, preparatory to and for use in effecting "trolleying" movement of the suitcase.
Figure 7:
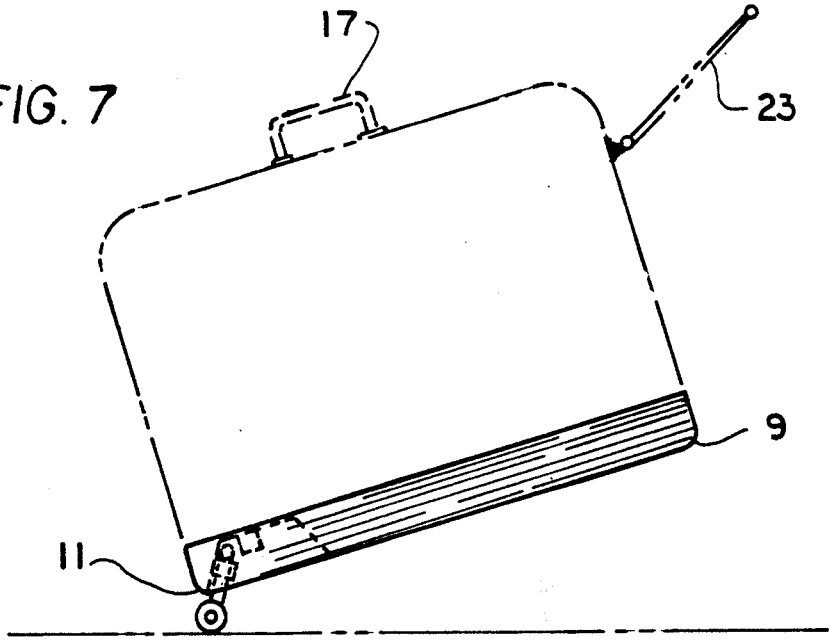
FIG. 7 is a side-elevational view showing a suitcase, with its rear wheels in their extended operative positions, preparatory to and for use in effecting "wheel-barrowing" movement of the suitcase.

In FIG. 1 of the drawings, reference numeral 1 generally refers to the invention showing a suitcase having two halves, a right half 3 and a left half 5, hinged together at their bottoms by a hinge 7 (shown in FIG. 4). The suitcase has four corners, right-side front and rear corners 9 and 11 (sown in FIG. 2) and left-side front and rear corners 13 and 15. The halves 3 and 5 are securable together at their tops by conventional means, not shown, such as by clasps or locks. The suitcase has a grip handle 17. As shown in FIG. 1, the suitcase has a draw strap 19; as shown in FIG. 6, a collapsible draw bar 21; and as shown in FIG. 7, a draw strap 23. The suitcase's bottom base is made of rigid plastic material and the four corners 9, 11, 13 and 15 each have inverted wells 25 of similar construction and configuration. In FIG. 7, the suitcase has only an inverted well in its right-side rear corner and an inverted well (not shown) in its left-side rear corner. Each of the inverted wells has and defines a closed top portion 27, front and rear opposite end walls 29 and 31, right-side and left-side opposite lateral walls 33 and 35, and an open bottom portion 37.

Each inverted well 25 houses a retractable wheel assembly 39, having a forward bifurcated bracket 41 whose base 43 is riveted to the closed top portion 27, as shown; and a rearward bifurcated bracket 45 whose base 47 is riveted to the rear-end wall 31, as shown. The forward bifurcated bracket 41 projects right-side and left-side opposed lateral sides 49 and 51 having mutually facing aligned detent recesses 53. The rearward bifurcated bracket 45 projects right-side and left-side opposed lateral sides 55 and 57 having mutually facing aligned detent recesses 59.

The right-side and left-side lateral walls 33 and 35 carry aligned bearings 61, adhesively affixed thereto, which pivotally mount a transverse pin 63 carrying one end 65 of an elongated arm 67 that has laterally projecting spring-biased detents 69, aligned by the elongated arm's angular pivotal moving relationship with either the forward aligned detent recesses 53 in the opposed lateral sides 49 and 51 of the forward bifurcated bracket 41, or with the rearward aligned detent recesses 59 in the opposed lateral sides 55 and 57 of the rearward bifurcated bracket 45.

The elongated arm 67 has an opposite end 71 carrying a transverse axle 73 freely mounting lateral wheels 75, retained thereon by spring clips 77. The elongated arm 67 has two positions of manipulatively pivotal angular movements between a first retracted position and a second extended operative position. A finger hold 79, formed and provided on the opposite end 71 of the elongated arm 67, facilitates its movements be-the two positions. In its first retracted position, shown in full lines in FIGS. 1, 2 and 3, and in broken lines in FIG. 4, the elongated arm's spring-biased detents 69 are engaged in manipulatively releasable locking engagements with the forward aligned detent recesses 53, and with the elongated arm 67 and its lateral wheels 75 being spatially above the inverted-well's open bottom portion 37 and within the inverted-well's interior. In its second extended operative position, shown in full lines in FIGS. 4, 6 and 7, and in broken lines in FIGS. 1, 2 and 3, the elongated arm's spring-biased detents 69 are engaged in manipulatively releasable locking engagements with the rearward aligned detent recesses 59, and with the lateral wheels 75 being below the inverted-well's open bottom portion 37 and touching a floor or ground surface. It should be noted that the expression "manipulatively releasable locking engagement" means that the elongated arm's spring-biased detents 69 can be disengaged from the aligned detent recesses by a human operator's simply disposing one of his fingers upon the finger hold 79 and appropriately pressing the finger hold 79 to pivot the elongated arm 67 sufficiently in the appropriate direction to free the spring-biased detents 69 from their locking engagements with their immediate detent recesses.

The wheels 75 in their second extended operative positions via their arms 67, are shown in FIG. 6 in full lines for "trolleying" movement of the suitcase, i.e., with all four sets of wheels touching the floor or ground surface. The wheels 75 in their second extended operative positions, via their arms 67, are shown in full lines in FIG. 7, and in broken lines in FIG. 2, for "wheel-barrowing" movement of the suitcase, i.e., with only the rear wheels touching the floor or ground surface.

Figure 5:
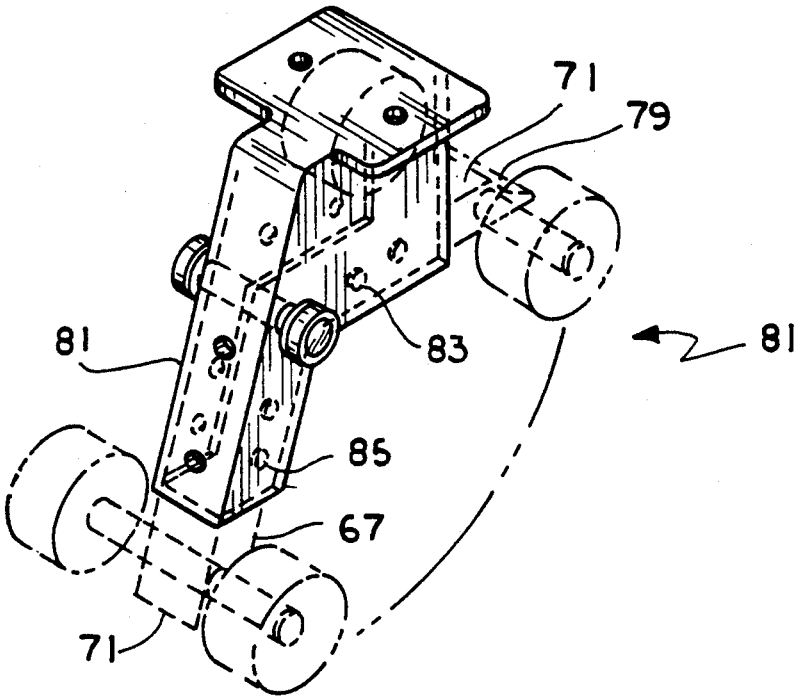
FIG. 5 is a perspective view, showing a modification of the wheel assembly structure of FIG. 3.

The only structural difference between the retractable wheel assembly 39 and its modification, shown in FIG. 5, is that the separate forward and rearward bifurcated brackets 41 and 49 are united in one bifurcated bracket (generally referred to by reference numeral 18) riveted to both the closed top portion 27 and the rear-end wall 31. The forward aligned detent recesses 83 function the same as the forward detent recesses 53 and the rearward aligned detent recesses 85 function the same as the rearward detent recesses 59.

It should further be appreciated that the finger hold 79 facilitates the human operator's moving the arm 67 out of its first retracted position and into its second extended operative position, as well as out of the arm's second extended operative position and into its first retracted position, with the inside facing surfaces of the bracket's lateral sides camming and thereby compressing the arm's spring-biased detents to disengage and free such spring-biased detents from their locking engagements with their immediate detent recesses.

I claim:

1. In an article of luggage having two halves, hinged at their bottoms and securable at their tops, with the article having right-side front and rear corners and left-side front and rear corners, said article's right-side rear and left-side rear corners each having an inverted well having an interior and housing a retractable wheel assembly, said inverted wells each having and defining a closed top portion, front and rear opposite walls, right-side and left-side opposite lateral walls, and an open bottom portion, said inverted-well's closed portion and rear-end wall carrying respective forward and rearward bifurcated brackets projecting right-side and left-side opposed lateral sides having therein respective forward and rearward aligned detent recesses, said forward and rearward bifurcated brackets being spatially above the inverted-well's open bottom portion and within the inverted-well's interior, said inverted-well's right-side and left-side opposite lateral walls carrying aligned bearings pivotally mounting a transverse pin carrying one end of an elongated arm having laterally projecting spring-biased detents, aligned in its angular pivotal moving relationship with either said forward aligned detent recesses in the opposed lateral sides of said forward bifurcated bracket, or with said rearward aligned detent recesses in the opposed lateral sides of said rearward bifurcated bracket, said elongated arm having an opposite end carrying a transverse axle freely mounting wheels, said elongated arm having two positions of manipulatively pivotal angular movements between a first retracted position and a second extended operative position, in its first retracted position said elongated arm's detents are engaged in manipulatively releasable locking engagements with said forward aligned detent recesses, and with said elongated arm and said wheels being spatially above the inverted-well's open bottom portion and within the inverted-well's interior, and, in its second extended operative position said elongated arm's detents are engaged in manipulatively releasable locking engagements with said rearward aligned detent recesses, and with the wheels being below the inverted-well's open bottom portion, preparatory to and for use in effecting "wheel-barrowing" movement of the article via the wheels.

2. An assembly in accordance with claim 1, wherein said opposite end of the arm has a terminal end having a finger hold adapted for a human operator's disposing one of his fingers upon the finger hold and appropriately pressing the finger hold to move the arm in an opposite direction to disengage and free the arm's detents from their locking engagements with the forward detent recesses and move the arm to its second extended operative position whereat the arm's detents will be in locking engagements with the rearward detent recesses; or to disengage and free the arm's detents from their locking engagements with the rearward detent recesses and move the arm to its first retracted position whereat the arm's detents will be in locking engagements with the forward detent recesses.

3. In an article of luggage having two halves, hinged at their bottoms and securable at their tops, with the article having right-side front and rear corners and left-side front and rear corners, all of said article's corners having inverted wells each having an interior and housing a retractable wheel assembly, said inverted wells each having and defining a closed top portion, front and rear opposite end walls, right-side and left-side opposite lateral walls, and an open bottom portion, said inverted-well's closed top portion and rear-end wall carrying respective forward and rearward bifurcated brackets projecting right-side and left-side opposed lateral sides having therein respective forward and rearward aligned detent recesses, said forward and rearward bifurcated brackets being spatially above the inverted-well's open bottom portion and within the inverted-well's interior, said inverted-well's right-side and left-side opposite lateral walls carrying aligned bearings pivotally mounting a transverse pin carrying one end of an elongated arm having laterally projecting spring-biased detents, aligned in its angular pivotal moving relationship with either said forward aligned detent recesses in the opposed lateral sides of said forward bifurcated bracket, or with said rearward aligned detent recesses in the opposed lateral sides of said rearward bifurcated bracket, said elongated arm having an opposite end carrying a transverse axle freely mounting wheels, said elongated arm having two positions of manipulatively pivotal angular movements between a first retracted position and a second extended operative position, in its first retracted position said elongated arm's detents are engaged in manipulatively releasable locking engagements with said forward aligned detent recesses, and with said elongated arm and wheels being spatially above the inverted-well's open bottom portion and within the inverted-well's interior, and, in its second extended operative position said elongated arm's detents are engaged in manipulatively releasable locking engagements with said rearward aligned detent recesses, and with the wheels being below the inverted-well's open bottom portion, preparatory to and for use in effecting "trolleying" movement of the article via the wheels.

4. An assembly in accordance with claim 3, wherein said opposite end of the arm has a terminal end having a finger hold adapted for a human operator's disposing one of his fingers upon the finger hold and appropriately pressing the finger hold to move the arm in an opposite direction to disengage and free the arm's detents from their locking engagements with the forward detent recesses to move the arm to its second extended operative position whereat the arm's detents will be in locking engagements with the rearward detent recesses; or to disengage and free the arm's detents from their locking engagements with the rearward detent recesses and move the arm to its first retracted position whereat the arm's detents will be in locking engagements with the forward detent recesses.

5. In an article of luggage having two halves, hinged at their bottoms and securable at their tops, with the article having right-side front and rear corners and left-side front and rear corners, and article's right-side rear and left-side rear corners each having an inverted well having an interior and housing a retractable wheel assembly, said inverted wells each having and defining a closed top portion, front and rear opposite end walls, right-side and left-side opposite lateral walls, and an open bottom portion, said inverted-well's closed top portion and rear-end wall carrying a bifurcated bracket projecting right-side and left-side opposed lateral sides having therein forward aligned detent recesses and rearward aligned detent recesses, said bifurcated bracket being spatially above the inverted-well's open bottom portion and within the inverted-well's interior, said inverted-well's right-side and left-side opposite lateral walls carrying aligned bearings pivotally mounting a transverse pin carrying one end of an elongated arm having laterally projecting spring-biased detents, aligned in its angular pivotal moving relationship with either said forward aligned detent recesses in said opposed lateral sides of said bifurcated bracket or with said rearward aligned detent recesses in said opposed lateral sides of said bifurcated bracket, said elongated arm having an opposite end carrying a transverse axle freely mounting wheels, said arm having two positions of manipulatively pivotal angular movements between a first retracted position and a second extended operative position, in its first retracted position, said elongated arm's detents are engaged in manipulatively releasable locking engagements with said forward aligned detent recesses, and with said elongated arm and wheels being spatially above the inverted-well's open bottom portion and within the inverted-well's interior, and, in its second extended operative position said elongated arm's detents are engaged in manipulatively releasable locking engagements with said rearward aligned detent recesses, and with the wheels being below the inverted-well's open bottom portion, preparatory to and for use in effecting "wheel-barrowing" movement of the article via the wheels.

6. An assembly in accordance with claim 5, wherein said opposite end of the arm has a terminal end having a finger hold adapted for a human operator's disposing one of his fingers upon the finger hold and appropriately pressing the finger hold to move the arm in an opposite direction to disengage and free the arm's detents from their locking engagements with the forward detent recesses to move the arm to its second extended operative position whereat the arm's detents will be in locking engagements with the rearward detent recesses; or to disengage and free the arm's detents from their locking engagements with the rearward detent recesses and to move the arm to its first retracted position whereat the arm's detents will be in locking engagements with the forward detent recesses.

7. In an article of luggage having two halves, hinged at their bottoms and securable at their tops, with the article having right-side front and rear corners and left-side front and rear corners, all of said article's corners having inverted wells each having an interior and housing a retractable wheel assembly, said inverted wells each having and defining a closed top portion, front and rear opposite end walls, right-side and left-side opposite lateral walls, and an open bottom portion, said inverted-well's closed top portion and rear-end wall carrying a bifurcated bracket projecting right-side and left-side opposed lateral sides having therein forward aligned detent recesses and rearward aligned detent recesses, said bifurcated bracket being spatially above the inverted-well's open bottom portion and within the inverted-well's interior, said inverted-well's right-side and left-side opposite lateral walls carrying aligned bearings pivotally mounting a transverse pin carrying one end of an elongated arm having laterally projecting spring-biased detents, aligned in its angular pivotal moving relationship with either said forward aligned detent recesses in said opposed lateral sides of said bifurcated bracket or with said rearward aligned detent recesses in said opposed lateral sides of said bifurcated bracket, said elongated arm having an opposite end carrying a transverse axle freely mounting wheels, said elongated arm having two positions of manipulatively pivotal angular movements between a first retracted position and a second extended operative position, in its first retracted position, said elongated arm's detents are engaged in manipulatively releasable locking engagements with said forward aligned detent recesses, and with said elongated arm and wheels being spatially above the inverted-well's open bottom portion and within the inverted-well's interior, and, in its second extended operative position said elongated arm's detents are engaged in manipulatively releasable locking engagements with said rearward aligned detent recesses, and with the wheels being below the inverted-well's open bottom portion, preparatory to and for use in effecting "trolleying" movement of the article via the wheels.

8. An assembly in accordance with claim 7, wherein said opposite end of the arm has a terminal end having a finger hold adapted for a human operator's disposing one of his fingers upon the finger hold and appropriately pressing the finger hold to move the arm in an opposite direction to disengage and free the arm's detents from their locking engagements with the forward detent recesses to move the arm to its second extended operative position whereat the arm's detents will be in locking engagements with the rearward detent recesses; or to disengage and free the arm's detents from their locking engagements with the rearward detent recesses and move the arm to its first retracted position whereat the arm's detents will be in locking engagements with the forward detent recesses.

* * * * *